US009406465B1

(12) United States Patent
Fasano

(10) Patent No.: US 9,406,465 B1
(45) Date of Patent: Aug. 2, 2016

(54) POLARITY INSENSITIVE ARC QUENCH

(71) Applicant: Michael Fasano, Watertown, CT (US)

(72) Inventor: Michael Fasano, Watertown, CT (US)

(73) Assignee: Carling Technologies, Inc., Plainville, CT (US)

( * ) Notice: Subject to any disclaimer, the term of this patent is extended or adjusted under 35 U.S.C. 154(b) by 0 days.

(21) Appl. No.: 14/813,966

(22) Filed: Jul. 30, 2015

(51) Int. Cl.
*H01H 33/18* (2006.01)
*H01H 33/08* (2006.01)

(52) U.S. Cl.
CPC ..... *H01H 33/182* (2013.01); *H01H 33/08* (2013.01)

(58) Field of Classification Search
CPC ..... H01H 9/443; H01H 33/38; H01H 9/346; H01H 33/666; H01H 33/182; H01H 33/596; H01H 1/54; H01H 33/04
See application file for complete search history.

(56) References Cited

U.S. PATENT DOCUMENTS 4,679,019 A * 7/1987 Todaro ..... H01H 71/50 335/169
4,680,562 A * 7/1987 Bratkowski ..... H01H 71/2418 335/16
2007/0210885 A1* 9/2007 Nakano ..... H01H 9/302 335/201
2008/0030289 A1* 2/2008 Kralik ..... H01H 9/34 335/201
2009/0120908 A1* 5/2009 Domejean ..... H01H 9/346 218/23
2012/0037598 A1 2/2012 Fasano
2012/0261382 A1 10/2012 Fasano
2013/0284702 A1* 10/2013 Hamada ..... H01H 9/302 218/26

FOREIGN PATENT DOCUMENTS

EP 2605265 * 6/2013 ..... H01H 73/18

* cited by examiner

*Primary Examiner* — Truc Nguyen

(74) *Attorney, Agent, or Firm* — St. Onge Steward Johnston & Reens, LLC

(57) ABSTRACT

Circuit interrupter having an arc extinguisher which functions to arrest an arc between its contacts regardless of the polarity of the contacts. The circuit interrupter includes one or more permanent magnets configured to drive an arc into the arc extinguisher. The arc extinguisher may include two arc paths, each including arc splitter plates. The two arc paths may be adjacent, each extending in a parallel direction. The arc paths may alternatively be non-adjacent, each extending in a perpendicular direction.

20 Claims, 15 Drawing Sheets

POLARITY INSENSITIVE ARC QUENCH

FIELD OF THE INVENTION

The present invention relates generally to the protection of electrical devices, and more specifically, to arc extinguishing structures that are configured to rapidly extinguish an electrical arc regardless of the polarity of current through a circuit interrupter.

BACKGROUND OF THE INVENTION

Circuit interrupters are electrical components that are used to open an electrical circuit, interrupting the flow of current. A basic example of a circuit interrupter is a switch, which generally consists of two electrical contacts in one of two states; either closed, meaning that the contacts are in electrical contact with each other allowing electricity to flow between them, or open, meaning that the contacts are not in electrical contact with each other preventing the flow of electricity. A switch may be directly manipulated to provide a control signal to a system, such as a computer keyboard button, or to control power flow in a circuit, such as a light switch.

Another example of a circuit interrupter is a circuit breaker. A circuit breaker may be used, for example, in an electrical panel to limit the amount of current flowing through the electrical wiring. A circuit breaker is designed to protect an electrical circuit from damage caused by, for example, an overload, a ground fault or a short circuit. If a fault condition, such as, a power surge occurs in the electrical wiring, the breaker will trip. This will cause a breaker that was in an "on" position to flip to an "off" position and interrupt the flow of electrical power through the breaker. Circuit breakers are generally provided to protect the electrical wiring by limiting the amount of current transmitted through the wires to a level that will not damage them. Circuit breakers can also prevent destruction of the devices that may draw too much current.

A standard circuit breaker has a terminal connected to a source of electrical power, such as, a power line electrically connected to the secondary of a power company transformer, and second terminal electrically connected to the wires that the breaker is intended to protect. Conventionally, these terminals are referred to as the "line" and "load" respectively. The line is sometimes referred to as the input of the circuit breaker. The load, is sometimes referred to as the output of the circuit breaker, which connects to the electrical circuit and components receiving the electrical power.

A circuit breaker may be used to protect the electrical wiring that feeds an individual device, or a number of various devices. For example, an individual protected device, such as a single air conditioner, may be directly connected to a circuit breaker. Alternatively, circuit breaker may also be used to protect the wiring feeding multiple devices that may be connected to the circuit via various electrical outlets (e.g., various devices in a room each plugged into an outlet all on the same circuit).

A circuit breaker can be used as a replacement for a fuse. Unlike a fuse however, which typically operates to open in an over current situation once and then must be replaced; a circuit breaker can be "reset" (either manually or automatically) to resume operation. Fuses perform a similar role to circuit breakers, however, circuit breakers are easier to use and typically safer to service and operate.

In a situation where a fuse blows (open) thereby interrupting power to a circuit, it may not be apparent which of the multiple fuses in the panel, feeds the interrupted circuit. Typically, all of the fuses in the electrical panel would need to be inspected to determine which fuse is burned or spent. This fuse would then need to be removed and a new fuse installed.

Alternatively, in the situation where a circuit breaker trips, it is apparent which circuit breaker feeds the interrupted circuit by simply looking at the electrical panel and noting the breaker has tripped to the "off" position. This breaker can then be simply flipped to the "on" position and power will resume.

In general, a single pole circuit interrupter has two contacts positioned inside of a housing. The first contact is stationary and may be connected to either the line or the load. The second contact is movable with respect to the first contact, such that when the circuit breaker is in the "off" or tripped position, a gap exists between the first and second contact.

A problem with the above-described circuit interrupters arises when energized contacts are opened while under load. As the contacts separate transitioning from a closed to an open position, or when the opposition occurs, when the close transitioning from an open to a closed position, an electric arc may be formed in the gap. Arcs are caused when the breakdown voltage between the contacts is positively related to distance under pressure and voltage conditions in typical applications.

The creation of an arc during switching or tripping the circuit interrupter can result in undesirable effects that negatively affect the operation of the circuit interrupter, even potentially creating a safety hazard.

These negative effects can have adverse consequences on the operation of the circuit interrupter.

One possible consequence is that the arc may short to other objects in the circuit interrupter and/or to surrounding objects, causing damage and presenting a potential fire or safety hazard.

Another consequence of arcing is that the arc energy damages the contacts, causing some material to escape into the air as fine particulate matter. The debris which has been melted off of the contacts can migrate or be flung into the mechanism of the circuit interrupter, destroying the mechanism or reducing its operational lifespan.

Another effect of arcing stems from the extremely high temperature of the arc (tens of thousands of degrees Celsius), which can impact the surrounding gas molecules creating ozone, carbon monoxide, and other dangerous compounds. The arc can also ionize surrounding gasses, potentially creating alternate conduction paths.

Because of these detrimental effects it is very important to quickly cool and quench the arc to prevent damage to the circuit interrupter and the above-described dangerous situations.

Various techniques for improved arc quenching are known. For example, U.S. Published Patent Applications No. 2012/0037598 and 2012/0261382, assigned to Carling Technologies, Inc., variously relate to the use of an electromagnetic field to guide an arc toward an arc splitter.

However, generating an electromagnetic field to move an arc requires the use of power, and generates heat in the device. In order to avoid these negative issues, it has been conceived to incorporate a permanent magnet into the circuit interrupter, which produces a magnetic field without requiring a supply of electricity. However, permanent magnets produce a magnetic field having a fixed direction with respect to the magnet. Thus, known solutions for guiding an arc into an arc path using a permanent magnet are circuit polarity dependent. This is due to the fact that an magnetic field produced by a fixed permanent magnet has a fixed direction. As such, the mechanism for magnetically guiding the arc into the path depends upon the direction the current is flowing through the circuit interrupter.

This is a significant limitation, as it prevents such devices from being installed in a circuit where the electrical polarity of the circuit reverses, such as in a typical AC circuit. Hazardous conditions may also arise in a situation where such a device is accidentally installed backwards in that the magnetic field intended to be used to enhance arc quenching will, in fact, operate to drive the arc away from the arc path.

It is therefore desired to provide arc quenching usable with a circuit interrupter that overcomes the above-described limitations.

SUMMARY OF THE INVENTION

Accordingly, it is an object of the present invention to provide a circuit interrupter having an arc extinguisher that functions to arrest an arc between the circuit interrupter contacts regardless of the polarity of the circuit.

It is a further object of the present invention to provide a circuit interrupter having permanent magnets configured to drive an arc into an arc extinguisher regardless of the direction that current is flowing through the circuit interrupter.

These and other objectives are achieved by providing a circuit interrupter that includes a first contact and a second contact movable into and out of electrical contact with each other; an arc extinguisher; a permanent magnet disposed to guide an arc that develops between the contacts into the arc extinguisher regardless of a polarity of the contacts.

In some implementations, the arc extinguisher comprises a first arc path and a second arc path. The first arc path may extend in a direction substantially parallel to the second arc path, or substantially perpendicular to the second arc path. The permanent magnet may be disposed to drive the arc into the first arc path when a polarity of the first contact is positive, and is disposed to drive the arc into the second arc path when the polarity of the first contact is negative.

In some implementations, the permanent magnet comprises a first permanent magnet and the circuit interrupter further includes a second permanent magnet that is positioned such that the magnetic field produced by the second permanent magnet permeates the area in which the arc may form. The second permanent magnet may be positioned substantially opposite from the first permanent magnet such that the magnetic fields of the two permanent magnets interact to influence any arc that may develop in the vicinity of the contacts.

In some implementations, the permanent magnet is positioned such that the first contact is between the permanent magnet and the second contact.

In some implementations, the permanent magnet is a torridly shaped magnet. An axis of revolution of the torridly shaped magnet may intersect the first contact, and the torridly shaped magnet may surround a conductor that is in electrical contact with the first contact. The torrid may be a hollow cylinder or any other suitable torrid shape. In some implementations, the permanent magnet may be a hollow square or other suitable shape.

The circuit interrupter may include at least one pole piece disposed to direct a magnetic field of the permanent magnet. The at least one pole piece may be disposed to concentrate the magnetic field in an area where the arc is generated.

Still further, a first magnetic field produced by the permanent magnet interacts with a second magnetic field produced by the arc such that the arc is directed toward the arc extinguisher regardless of whether the arc is emitted from the first contact or the second contact.

In some implementations, the arc extinguisher comprises at least one plate for splitting the arc into a first arc path and a second arc path. The first arc path may comprise a first plate and the second arc path may comprise a second arc plate that is different from the first arc plate. The first arc path and the second arc path may comprise a common arc runner. The circuit interrupter may include a lower arc runner in electrical contact with the first contact and having a first tab extending beneath the first arc path and a second tab extending beneath the second arc path.

Objects of the invention may be achieved by provision of a circuit interrupter providing for arc suppression. The circuit interrupter may comprise a first contact electrically connectable to a power source and a second contact electrically connectable to a load. The circuit interrupter is provided such that the first and second contacts are movable between a closed and open position relative to each other. The circuit interrupter further comprises an arc extinguisher for extinguishing an arc that develops in the vicinity of the first and second contacts and a permanent magnet disposed adjacent to at least one of the contacts and generating a magnetic field that permeates an area where the arc develops. The circuit interrupter is provided such that the magnetic field directs the arc toward the arc extinguisher regardless of a polarity of the contacts Other objects of the invention may be achieved by provision of a circuit interrupter providing for arc suppression. The circuit interrupter may comprise a first contact electrically connectable to a power source and a second contact electrically connectable to a load. The circuit interrupter is provided such that the first and second contacts are movable between a closed and open position relative to each other. The circuit interrupter further comprises an arc extinguisher for extinguishing an arc that develops in the vicinity of said first and second contacts, the arc extinguisher having a first arc path and a second arc path. The circuit interrupter still further comprises a first permanent magnet generating a first magnetic field and positioned on a side of the first contact opposite from the second contact, and a second permanent magnet generating a second magnetic field and positioned on a side of the second contact opposite from the first contact. The circuit interrupter is further provided such that the first and second magnetic fields interact with the arc so as to direct the arc to the arc extinguisher regardless of an instantaneous polarity of the contacts.

Other objects of the invention and its particular features and advantages will become more apparent from consideration of the following drawings and accompanying detailed description.

DETAILED DESCRIPTION OF THE INVENTION

Figure 1:
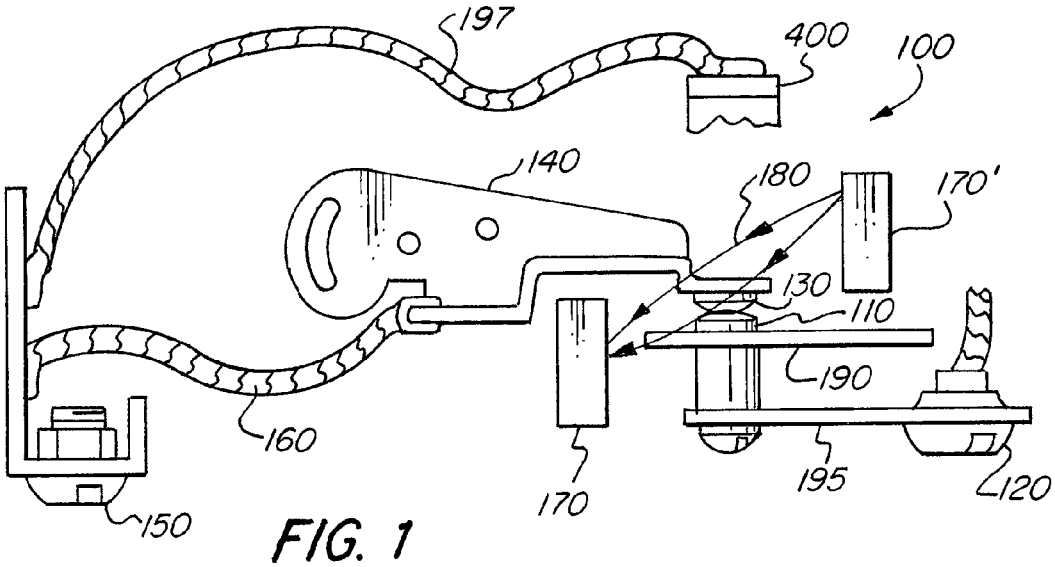
FIG. 1 illustrates components of an example circuit interrupter according to aspects of the invention.

FIG. 1 illustrates components of an example circuit interrupter 100 having polarity independent magnetic arc extinguishment features according to aspects of the invention.

Circuit interrupter 100 may be any device which can be used to make and break an electrical circuit. For example, it will be clear to those of skill in the art that circuit interrupter 100 may comprise a switch, or may be implemented as a circuit breaker.

Circuit interrupter 100 includes stationary contact 110, which is electrically connected to line terminal 120 via conductor 195. The line terminal receives electrical power from a power source (not shown), which in some applications is supplied by a power company. It will, however, be understood by those of skill in the art that the power may be provided and conditioned by any commercial means including, but not limited to, a commercial electrical power grid, a generator(s), solar panels, fuel cells, and so on. In the present example, stationary contact 110 is connected to a lower arc runner 190, as discussed in more detail below. Those of skill in the art will understand that lower arc runner 190 may be connected in a number of different configurations as desired without departing from aspects of the invention.

A movable contact 130 is disposed on a movable contact arm 140, which is movable between a closed and an open position relative to the stationary contact 110. In FIG. 1, contact arm 140 is shown in a closed position, with movable contact 130 physically contacting stationary contact 110.

Movable contact 130 is connected to load terminal 150 through a conductor 160. When contact arm 140 is in the closed position as shown, movable contact 130 is electrically connected to stationary contact 110 such that electrical current is allowed to flow between line terminal 120 and load terminal 150.

Permanent magnets 170 and 170' are disposed on opposite sides of the contacts 110, 130 and oriented to produce magnetic fields 180 through the region where an arc may form between contacts 110, 130.

Contact arm 140 may be actuated via a switch, trip mechanism, and/or any other known mechanism (not shown) depending on the desired implementation of circuit interrupter 100.

Permanent magnets 170, 170' are shown arranged in the same plane of travel of contact arm 140, but in a position where magnets 170, 170' will not obstruct the travel of contact arm 140, and at different heights with respect to the fixed contact 130. This arrangement provides the advantage of creating magnetic fields 180 which maintain a desired field strength and direction over the expected travel path of an arc generated between contacts 110, 130. While it has been found that the configuration illustrated in FIG. 1 provides exemplary results, it will be understood that other arrangements of permanent magnets may be evident to those of skill in the art. In the example depicted in FIG. 1, magnets 170 and 170' are oriented such that the individual magnetic fields produced by each magnet are additive such that a single, relatively strong magnetic field flows from one magnet to the other, although this may not be the case in other implementations.

Figure 2:
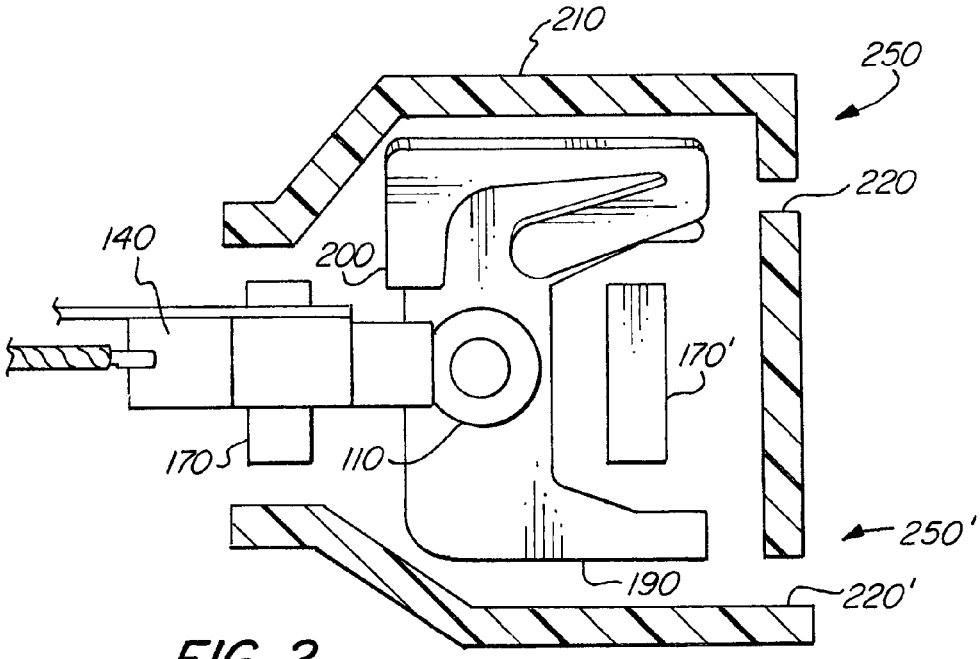
FIG. 2 is an overhead view of a portion of the circuit interrupter shown in FIG. 1.

FIG. 2 is an overhead view of a portion of the circuit interrupter 100 shown in FIG. 1, including additional components.

Lower arc runner 190 is shown extending perpendicularly to the contact arm 140, and having tabs extending away from contact arm 140 in a curve converging on a parallel with contact arm 140. Arc splitter plate 200 is shown arranged above lower arc runner 190 to one side of contact arm 140. The shapes of lower arc runner 190 and arc splitter plate 200 are contemplated to electromagnetically draw an arc into the arc splitter plate 200. These components are at least partially enclosed by housing 210.

Arc splitter plate 200 forms a part of an arc path through the intended region 250 into which an arc (not shown) that may develop between contacts 110, 130 would be directed by magnets 170, 170'. The corresponding region 250' would also contain an arc splitter plate (e.g., 200'); however, this plate is omitted for clarity to clearly illustrate the configuration of lower arc runner 190.

It will be evident to those of skill in the art that arc suppression is enhanced by the positioning and configuration of the arc splitter plates regardless of the polarity of the contacts. This arraignment further utilizes permanent magnets such that no electromagnetic energy is consumed and no additional heat is generated.

Housing 210 may include vents 220, 220' to allow gasses and debris that may be produced by any arcing that occurs to escape housing 210.

Figure 3:
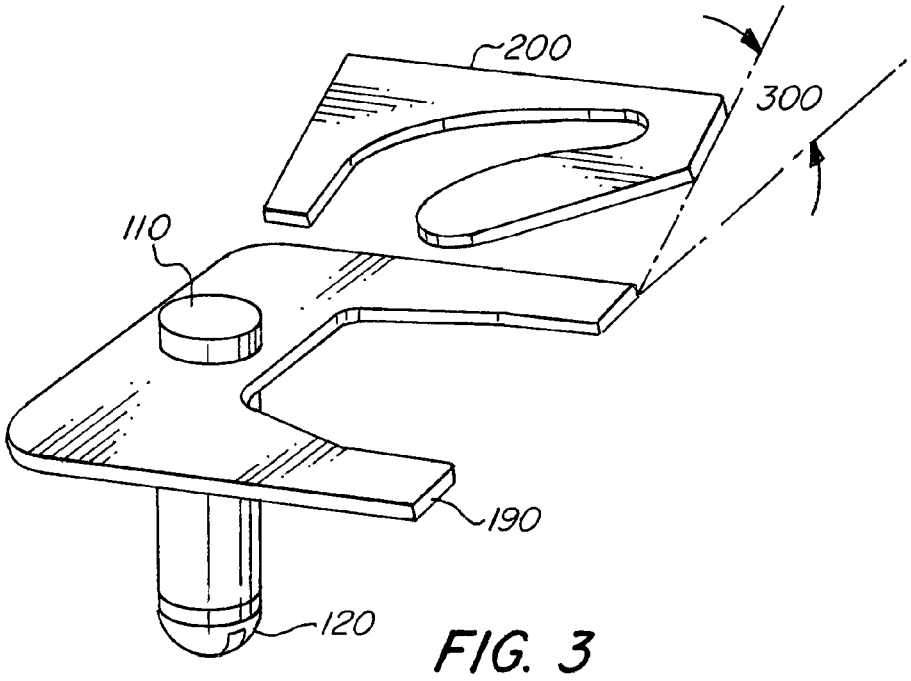
FIG. 3 is a perspective view of some of the components shown in FIGS. 1 and 2.

FIG. 3 is a perspective view of some components illustrated in FIGS. 1 and 2. Arc splitter plate 200 is shown positioned at an acute angle 300 relative to the lower arc runner 190. One advantage of providing the arc splitter plate 200 at an angle is that it allows for provision of a larger surface area for arc splitter plate 200 (increasing the total size of the plate) while at the same time allowing for the plate to be positioned in the housing 210 that continues to be relatively small in size. The increased surface area of arc splitter plate 200 functions to increase the efficiency of the arc splitter plate.

Figure 4:
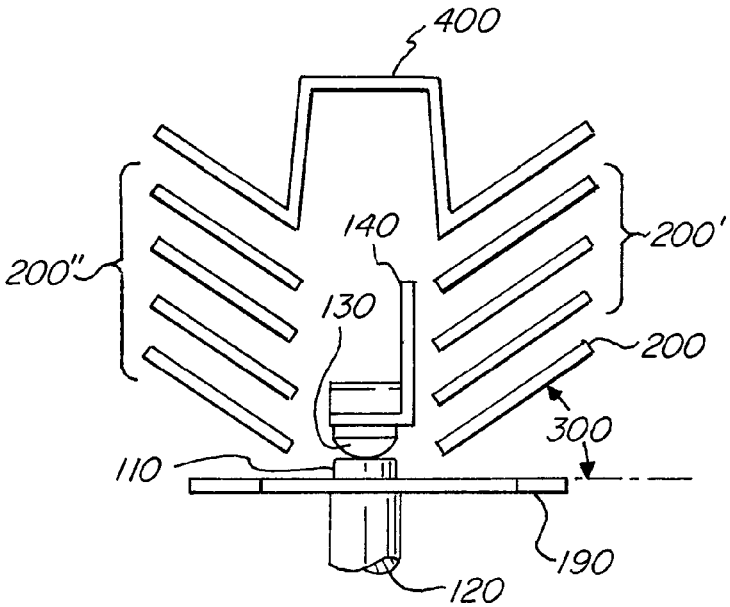
FIG. 4 is a side view of portions of the circuit interrupter 100 illustrated in FIGS. 1, 2, and 3.

FIG. 4 is a side view of portions of the circuit interrupter 100 illustrated in FIGS. 1, 2, and 3, illustrating still other components.

For example, arc splitter plate 200 is illustrated to be positioned at an acute angle 300 relative to lower arc runner 190. Additional arc splitter plates 200' and an upper arc runner 400 are shown stacked above arc splitter plate 200 to form an arc path in region 250.

A corresponding set of arc splitter plates 200" are illustrated positioned between lower arc runner 190 and upper arc runner 400 to form another arc path in region 250'.

It should be noted that while the arrangements of splitter plates in regions 250 and 250' are described as two arc paths, one of skill in the art could describe the system as a single arc extinguisher. In practice, an arc that develops between stationary contact 110 and movable contact 130 will, at any particular moment in time, be drawn into one of the arc paths. The region into which the arc is drawn depends upon the polarity of the contacts 110, 130 at the given time. In other words, the region into which the arc is drawn depends upon the instantaneous direction of current flow between contacts 110, 130.

Figure 5A:
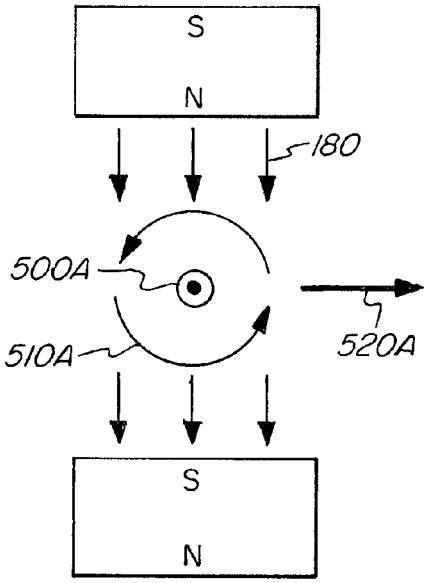
FIGS. 5A and 5B are overhead views of permanent magnets shown from the same perspective shown in FIG. 2.
Figure 5B:
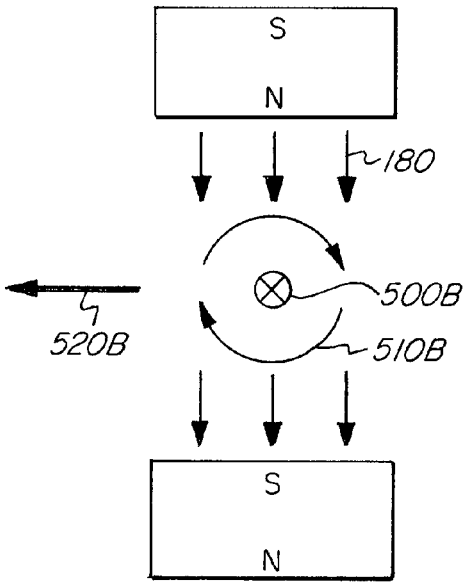

FIGS. 5A and 5B are top views of permanent magnets 170, 170' and illustrate the effect of magnetic field 180 upon an arc developing between contacts 110, 130.

For example, in FIG. 5A, an arc 500A is illustrated developing between stationary contact 110 and movable contact 130 (shown in FIGS. 1-4) when contact 110 is in a first state of charge and contact 130 is in a second state of charge opposite to the first state of charge. This state gives rise to an electromagnetic field 510A surrounding arc 500A in a counter-clockwise direction indicated. Electromagnetic field 510A interacts with magnetic field 180 to move arc 500A in the direction illustrated by arrow 520A (i.e., to the right in FIG. 5A). Referring to the corresponding structures in FIG. 2, this movement will drive the arc 500A into the arc splitter plates 200" of region 250' (FIG. 6) to be extinguished.

In FIG. 5B, an arc 500B is illustrated developing between stationary contact 110 from and movable contact 130 (shown in FIGS. 1-4) when contact 110 is in a second state of charge and contact 130 is in a first state of charge opposite to the second state of charge. This state gives rise to an electromagnetic field 510B surrounding arc 500B in a clockwise direction indicated. Electromagnetic field 510B interacts with magnetic field 180 to move arc 500B in the direction illustrated by arrow 520B (i.e., to the left in FIG. 5B). Referring to the corresponding structures in FIG. 2, this movement will drive the arc 500B into the arc splitter plates 200, 200' of region 250 (FIG. 6) to be extinguished.

Figure 6:
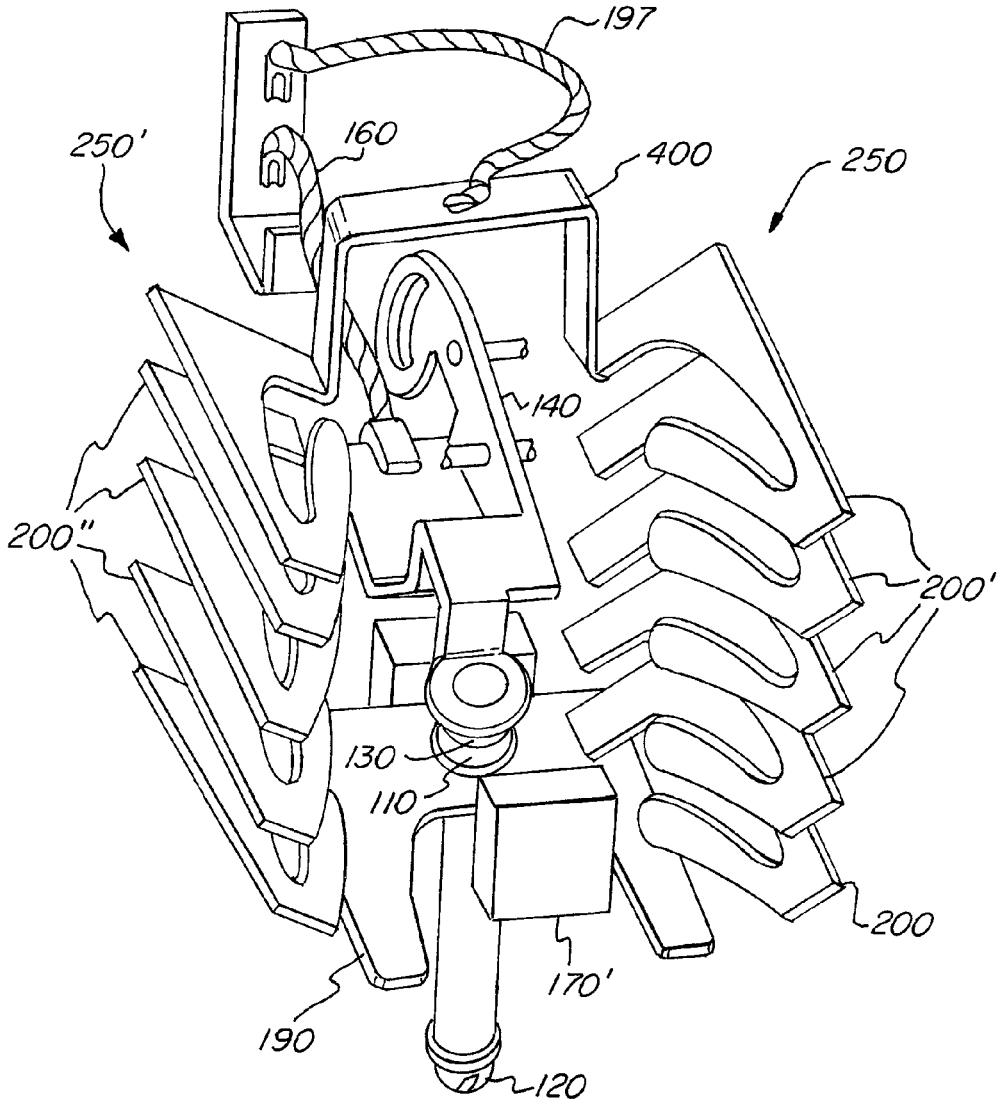
FIG. 6 is an orthographic view which further illustrates portions of the example circuit interrupter described with respect to FIGS. 1-5.

FIG. 6 is a perspective view further illustrating portions, structure and positioning of components of the circuit interrupter 100 described in connection with FIGS. 1-5.

Figure 7:
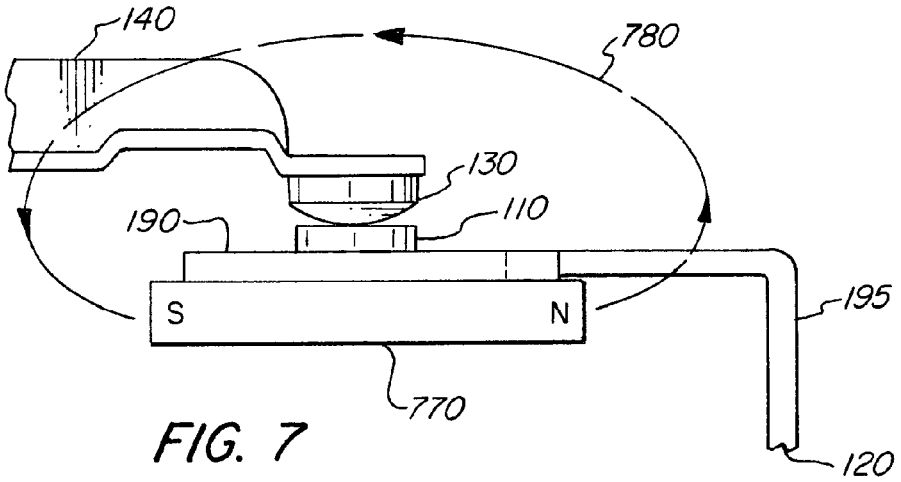
FIG. 7 illustrates components of the example circuit interrupter described with respect to FIGS. 1-6, showing an alternative arrangement of certain parts of the polarity-independent magnetic arc extinguishment features according to aspects of the invention.

FIG. 7 illustrates components of circuit interrupter 100 showing an alternative arrangement of certain parts according to aspects of the invention.

Stationary contact 110, line terminal 120, movable contact 130, and contact arm 140 are arranged in substantially the same configuration shown with respect to FIGS. 1-5. However, in the implementation of FIG. 6, permanent magnet 770 is located beneath stationary contact 110 as illustrated, and the permanent magnets 170, 170' of FIGS. 1-5 are not present. Permanent magnet 770 generates a magnetic field 780, which permeates a region where an arc between contacts 110, 130 may form.

Figure 8:
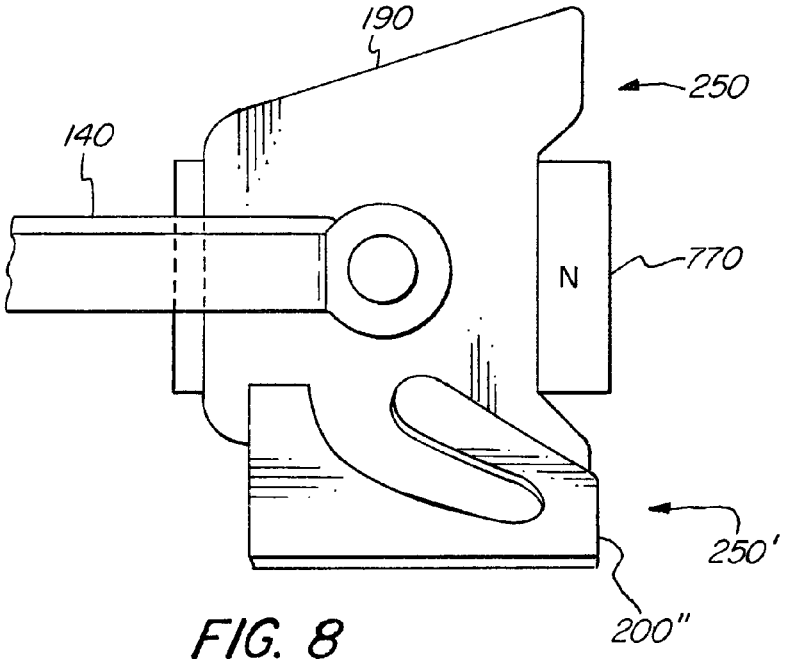
FIG. 8 illustrates an overhead view of components of example circuit interrupter as shown in FIG. 7.

FIG. 8 illustrates a top view of components of circuit interrupter 100 in the configuration of FIG. 7. The view shown in FIG. 8 illustrates the alternative placement of permanent magnet 770 with respect to contacts 110, 130, lower arc runner 190, and contact arm 180.

Although permanent magnet 770 is shown having a particular polarity, those having skill in the art will appreciate that the magnetic polarity may be reversed without departing from the invention.

Figure 9B:
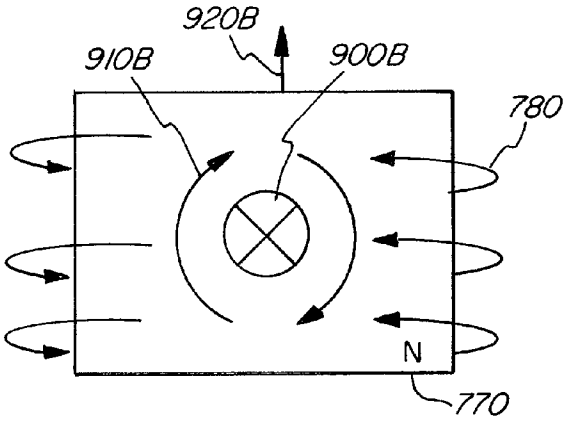
FIGS. 9A and 9B are overhead views of a permanent magnet shown from the same perspective shown in FIG. 7.
Figure 9A:
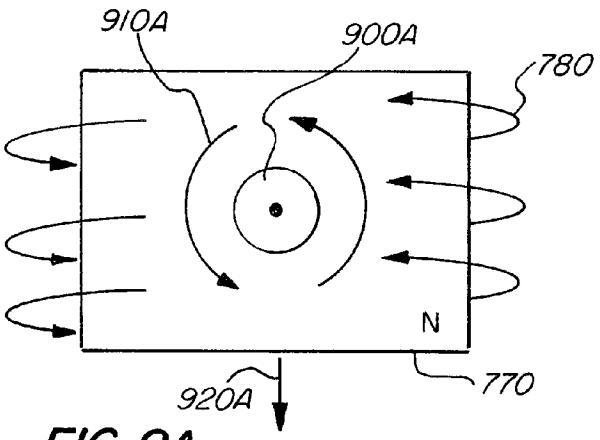

FIGS. 9A and 9B are overhead views of permanent magnet 770 from the same perspective shown in FIG. 7, and illustrate the effect of magnetic field 780 upon an arc developed between the contacts 110, 130.

In FIG. 9A, an arc 900A is shown developing between the stationary contact 110 and the movable contact 130 (contacts 110, 130 not shown for clarity). The electric charge of the arc gives rise to an electromagnetic field 910A surrounding arc 900A as illustrated. Electromagnetic field 910A interacts with magnetic field 780 to direct arc 900A as shown by arrow 920A.

Referring to the corresponding structures in FIG. 8, this movement will direct the arc 900A into region 250'.

In FIG. 9B, an arc 900B is shown developing between the stationary contact 110 and the movable contact 130 (contacts 110, 130 not shown for clarity) albeit where the charges on the contacts 110, 130 are reversed with respect to FIG. 9A. This electric charge of the arc gives rise to an electromagnetic field 910B surrounding arc 900B as illustrated. Electromagnetic field 910B interacts with magnetic field 780 to direct arc 900B as shown by arrow 920B.

Referring to the corresponding structures in FIG. 8, this movement will direct the arc 900B into region 250.

Figure 10B:
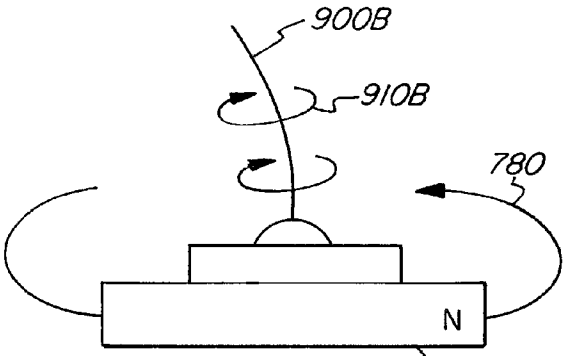
FIGS. 10A and 10B are side views of the permanent magnet as shown in FIGS. 9A and 9B.
Figure 10A:
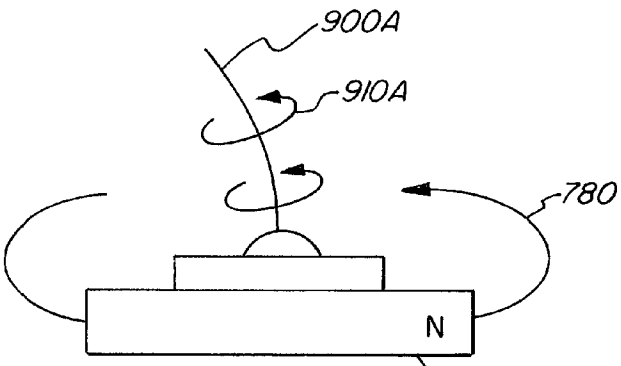

FIGS. 10A and 10B are side views of permanent magnet 770 and arcs 900A and 900B, further illustrating the relative orientations of magnetic field 780 and electromagnetic fields 910A and 910B.

Figure 11:
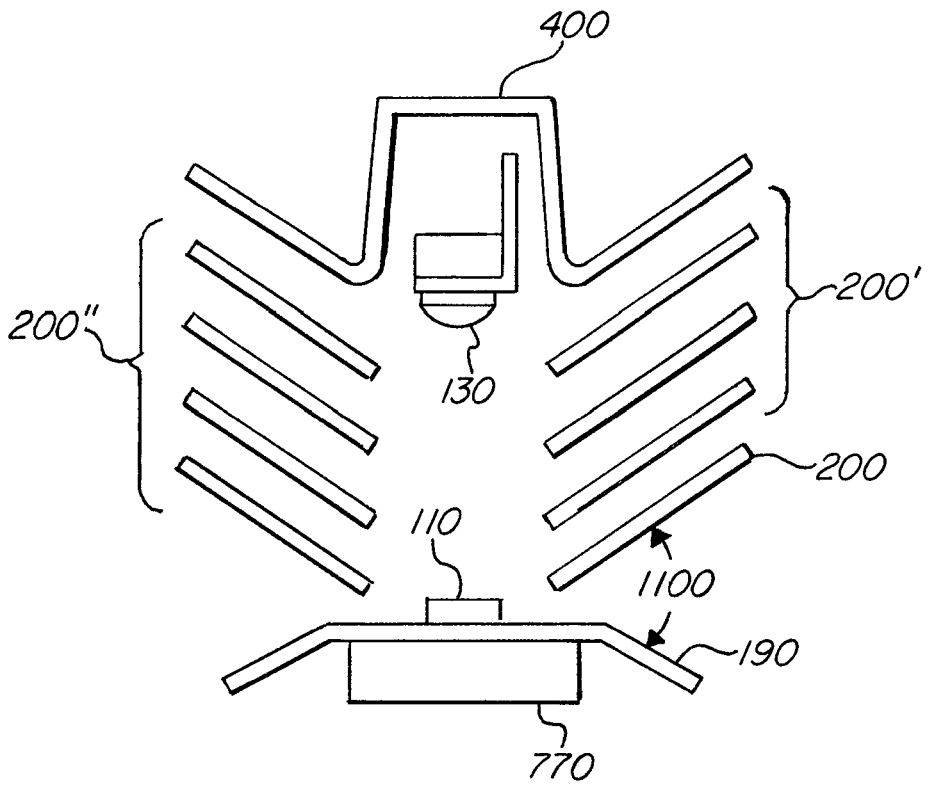
FIG. 11 is a side view of portions of the implementation of circuit interrupter illustrated in FIGS. 6, 7, 8A, 8B, 9A, and 9B.

FIG. 11 is a side view of portions of the implementation of circuit interrupter 100 illustrated in FIGS. 6, 7, 8A, 8B, 9A, and 9B. The view of FIG. 11 corresponds to the view shown in FIG. 4, and shows contact arm 140 in an open position. Magnetic field 780 (omitted for clarity) permeates the region between contacts 110, 130 where an arc may arise. Depending upon the polarity of contacts 110, 130, magnetic field 780 will direct such an arc toward the arc path in either region 250 or 250'. In addition, lower arc runner 190 is shown at an optional angle 1100 from arc splitter 200. This may have the advantage of facilitating an arc runner having a greater surface area in a housing 210 having a relatively small dimension.

Figure 12:
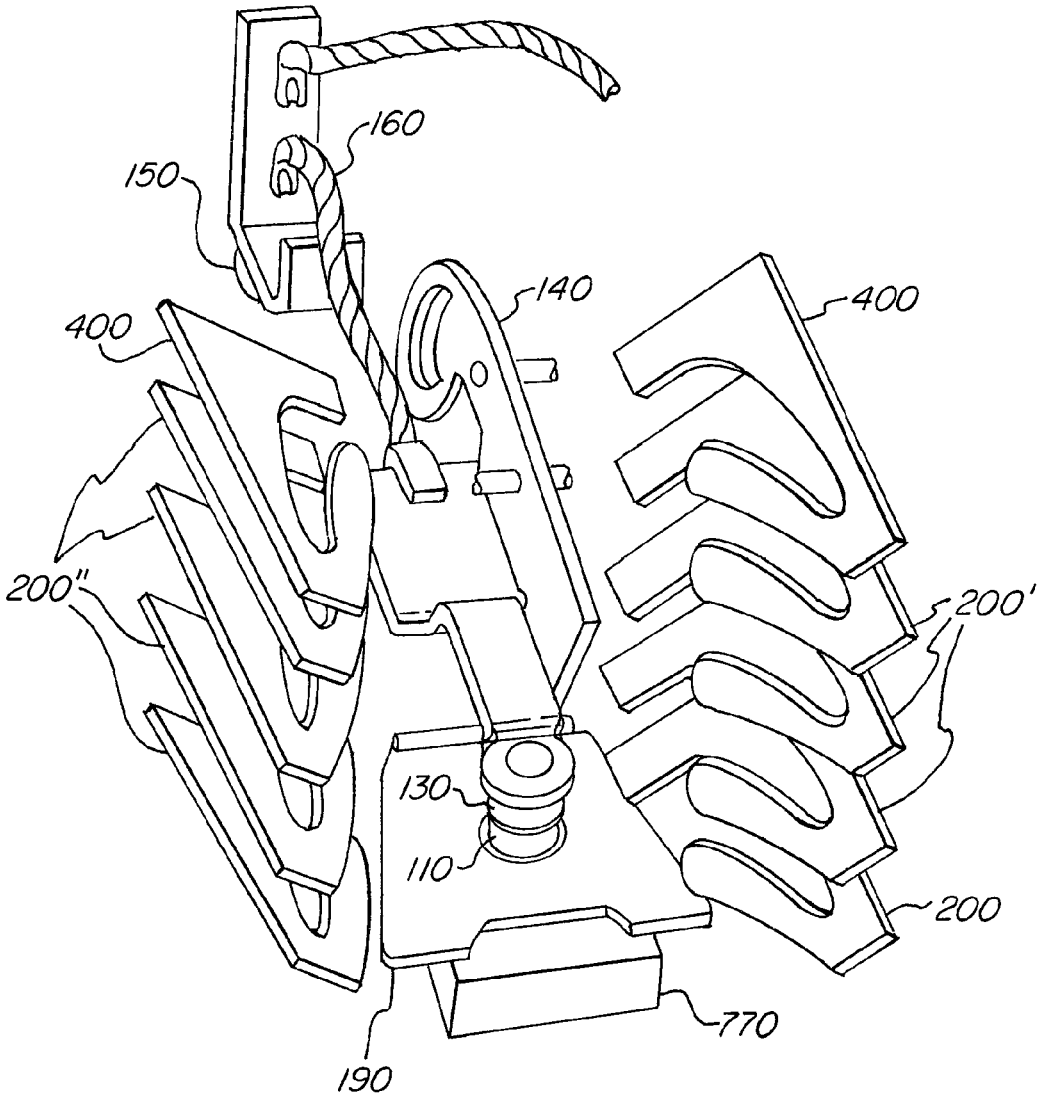
FIG. 12 is an orthographic view which further illustrates portions of the example circuit interrupter as described with respect to FIGS. 7-11.

FIG. 12 is a perspective view that further illustrates portions of the circuit interrupter 100 as described with respect to FIGS. 7-11.

Figure 13:
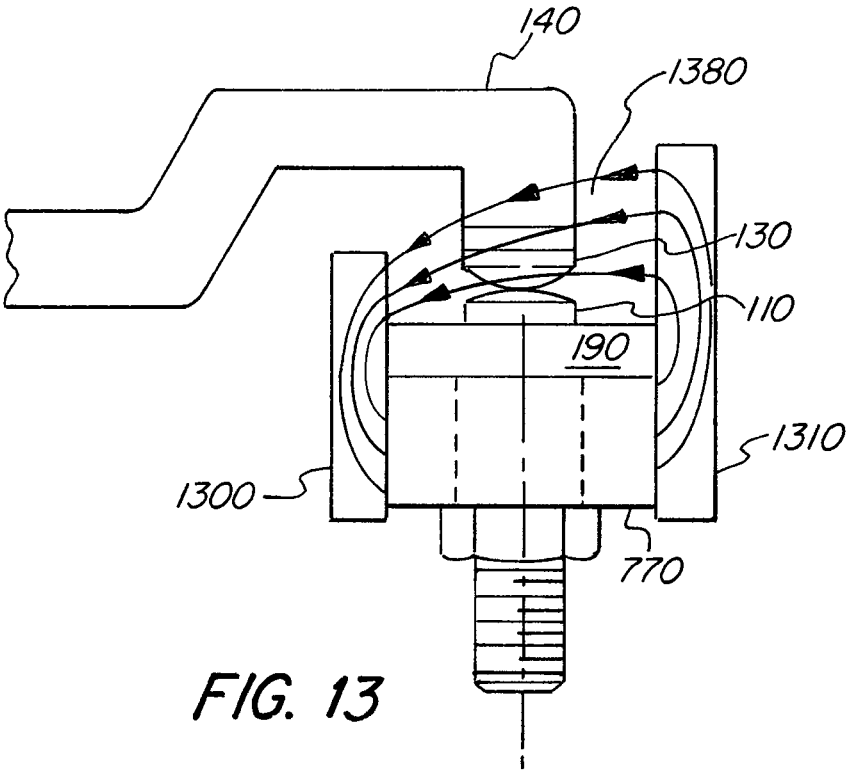
FIG. 13 illustrates components of the example circuit interrupter as described with respect to FIGS. 7-12, showing additional features.

FIG. 13 illustrates components of the implementation of circuit interrupter 100 shown in FIGS. 7-12. Contact arm 140, movable contact 130, stationary contact 110, and permanent magnet 770 are all arranged substantially as shown in FIG. 7, however, in FIG. 13 pole pieces 1300 and 1310 have been added adjacent to magnet 770. Pole pieces 1300 and 1310 are arranged to produce a shaped magnetic field 1380 through the region where an arc (not shown) may form between contacts 110, 130.

Using pole pieces to direct and/or concentrate a magnetic field in this manner allows for more precise control in directing and extinguishing an arc that forms between the contacts.

Pole pieces 1300 and 1310 may be made of any suitable material including, for example, but not limited to an iron material. Those of skill in the art will appreciate that one or more pole pieces comprising any desired shape may be used in conjunction with any of the magnet arrangements described herein or otherwise consistent with the invention to shape a desired magnetic field.

Figure 14:
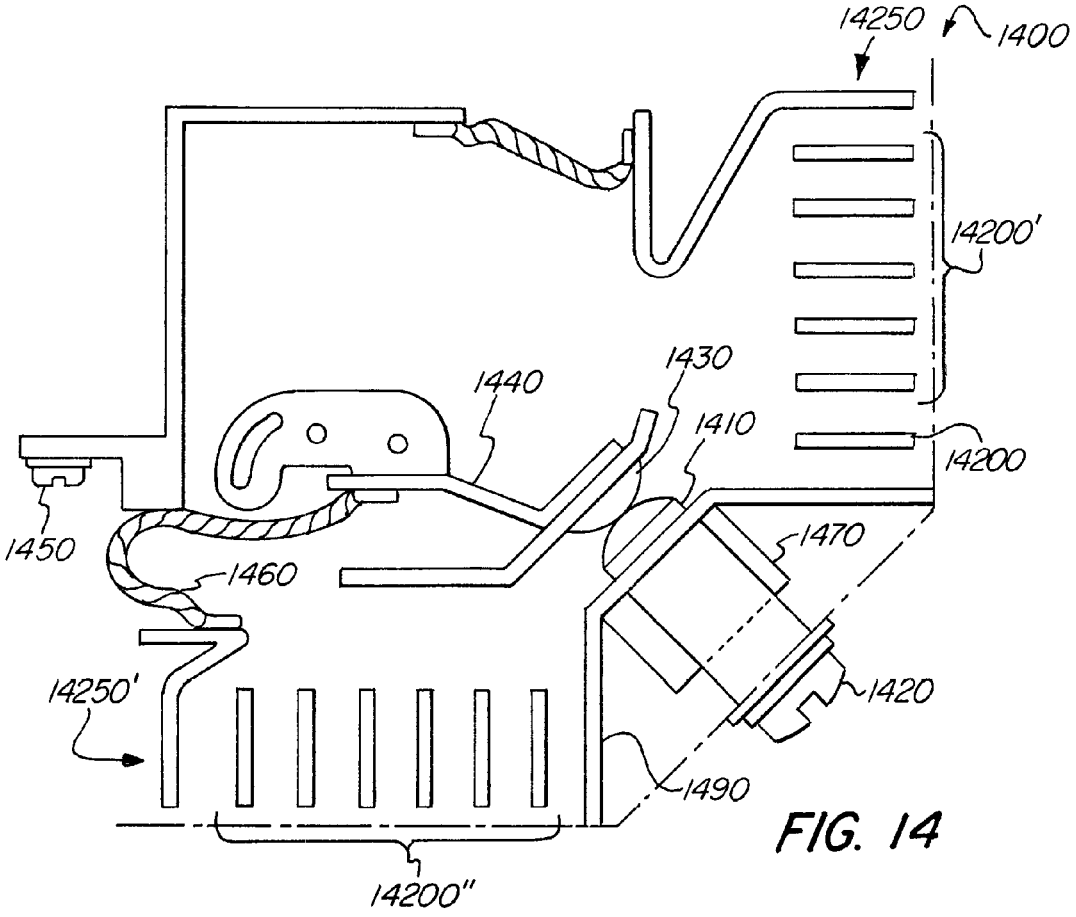
FIG. 14 illustrates another example circuit interrupter 1200 according to aspects of the invention.

FIG. 14 illustrates certain components of another circuit interrupter 1200 according to aspects of the invention. Circuit interrupter 1400 includes stationary contact 1410 which is electrically connected to line terminal 1420. Stationary contact 1410 is connected to a lower arc runner 1490, although those of skill in the art will appreciate that lower arc runner 1490 may be connected in different configurations without departing from the invention.

A movable contact 1430 is disposed on a movable contact arm 1440, which can be moved between a closed position and an open position. In FIG. 14, contact arm 1440 is shown in a closed position, with movable contact 1430 contacting stationary contact 1410.

Movable contact 1430 is connected to load terminal 1450 through a conductor 1460. When contact arm 1440 is in the closed position, movable contact 1430 physically contacts stationary contact 1410 such that electrical current can flow between line terminal 1420 and load terminal 1450.

A permanent magnet 1470 is located beneath stationary contact 1410 as shown, and oriented to produce a magnetic field 1480 (omitted for clarity) through the region where contacts 1410, 1430 touch when the contact arm 1440 is in the closed position and where an arc may form between contacts 1410, 1430 when the contacts open or close. Permanent magnet 1470 is shown comprising a hollow cylindrical shape arranged to surround line terminal 1420, however it will be appreciated by those of skill in the art that other shapes, and/or other arrangements may be utilized.

Circuit interrupter 1400 may be any device that can be used to open or close an electrical circuit. For example, circuit interrupter 1400 may be implemented as a switch, or may be implemented as a circuit breaker.

Contact arm 1440 may be actuated via a switch, trip mechanism, and/or any other known mechanism (not shown) according to the desired implementation of circuit interrupter 1400.

Lower arc runner 1490 is shown in electrical contact with stationary contact 1410. Arc splitter plates 14200 and 14200' are illustrated arranged in arc path 14250; and arc splitter plates 14200" is illustrated arranged in arc path 14250'. Depending upon the polarity of contacts 1410, 1430, an arc developing between the contacts will be directed toward either arc path 14250 or 14250' by the interaction of an electromagnetic field surrounding the arc (not shown) with magnetic field 1480 (omitted from FIG. 14 for clarity, shown in FIG. 15).

It will be evident to those of skill in the art that this arrangement provides for assisted arc suppression using arc splitter plates regardless of the polarity of the contacts, and using permanent magnets without requiring the consumption of power.

It is also clear that by arranging the arc paths 14250, 14250' and the magnetic field 1480 as shown in FIG. 14, the profile of circuit interrupter 1400 is made thinner than the profile of circuit interrupter 100, for the reason that the arc paths 14250, 14250' are not in a side-by-side configuration, and thus do not require the housing to be wider than a single arc path.

Figure 15:
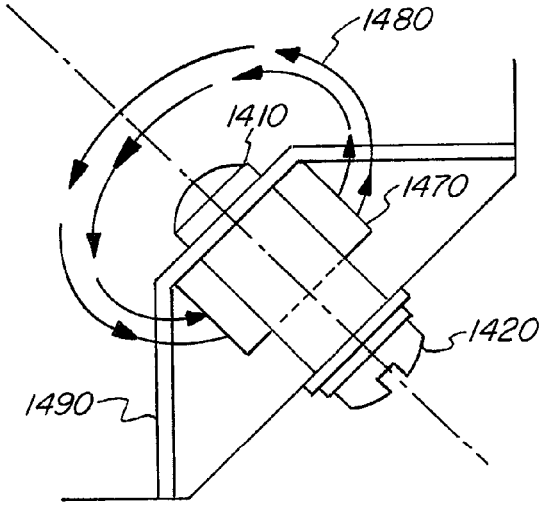
FIG. 15 shows portions of the example circuit interrupter shown in FIG. 14, further illustrating a portion of a magnetic field.

FIG. 15 illustrates portions of the circuit interrupter 1400 as shown in FIG. 14, further illustrating a portion of magnetic field 1480 which permeates the area where an arc may form between contacts 1410, 1430. The magnetic field functions to direct such arcs toward either region 14250 or 14250' depending upon the polarity of the contacts.

Figure 16:
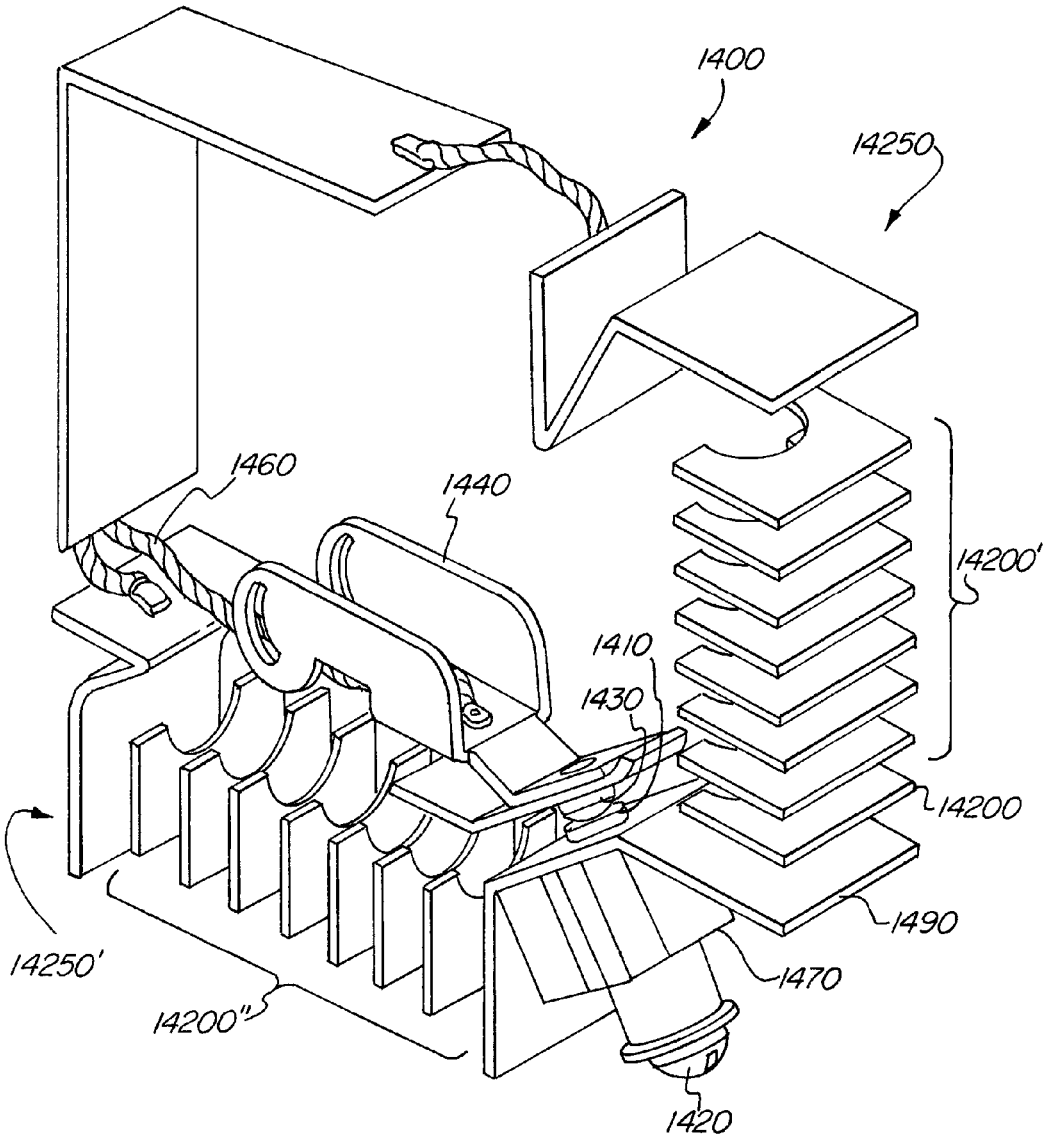
FIG. 16 is an orthographic view which further illustrates portions of the example circuit interrupter described with respect to FIGS. 13-15.

FIG. 16 is a perspective view, which further illustrates portions of the circuit interrupter 1400 described with respect to FIGS. 13-15; while FIGS. 17A-B and 18A-B show arrangements of certain components of circuit interrupters described herein.

Figure 17B:
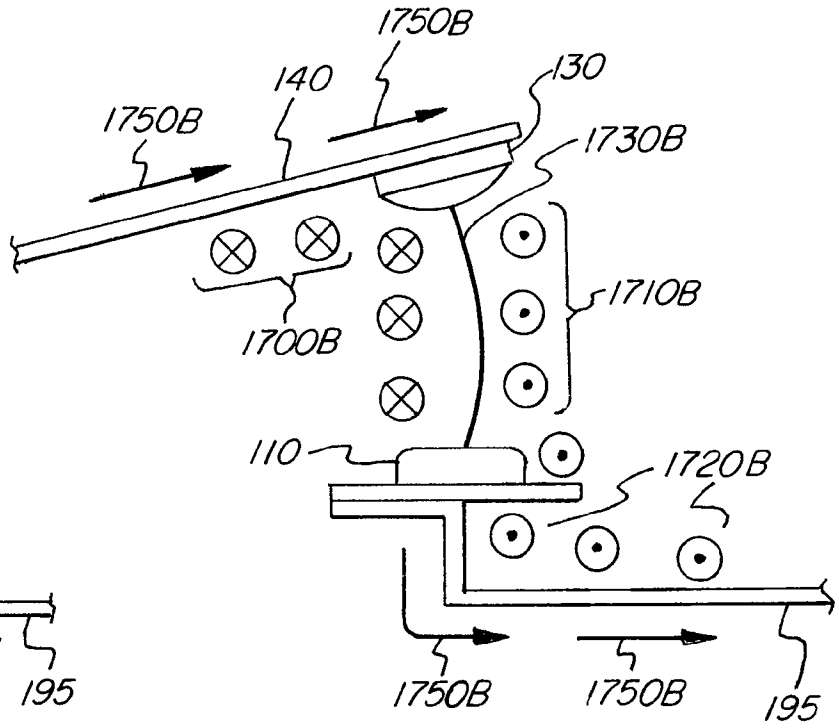
FIGS. 17A and 17B show an example arrangement of certain components of the example circuit interrupters described regarding FIGS. 1-16.
Figure 17A:
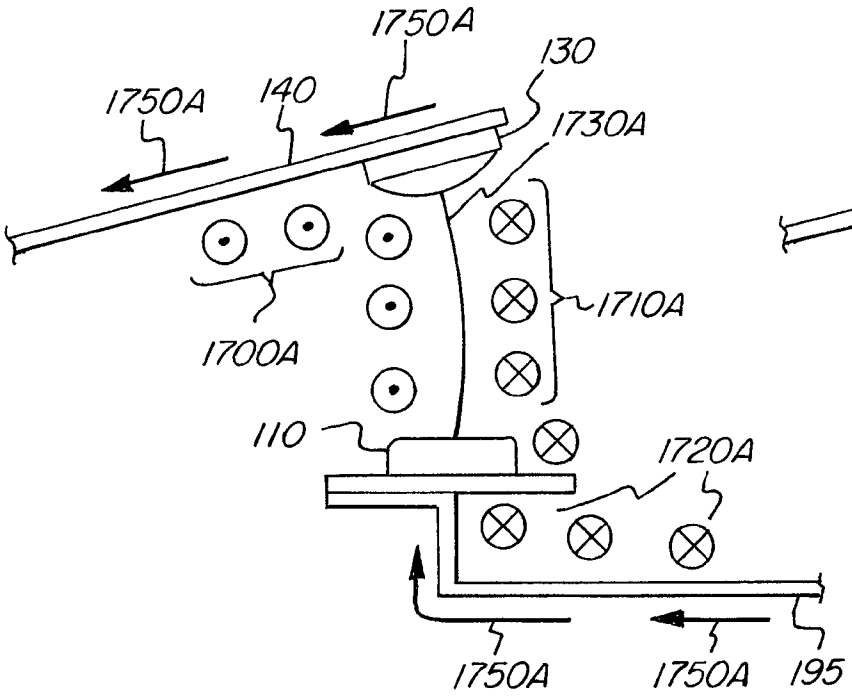

FIG. 17A illustrates the electromagnetic field generated by current flowing through contact arm 140 and conductor 195 according to aspects of the invention.

When current flows through conductor 195 and contact arm 140 in the direction indicated by arrows 1750A (i.e. line to load), it gives rise to electromagnetic fields 1700A and 1720A respectively. An arc developing between stationary contact 110 and movable contact 140 will generate an electromagnetic field 1710A. The conductor 195 and contact arm 140 are oriented and disposed such that the effect of electromagnetic fields 1700A and 1720A on the arc does not substantially hinder the directing of the arc into an arc path as compared with other possible implementations.

FIG. 17B illustrates the electromagnetic field generated by current flowing through contact arm 140 and conductor 195 according to aspects of the invention.

When current flows through conductor 195 and contact arm 140 in the direction indicated by arrows 1750B (i.e. load to line), it gives rise to electromagnetic fields 1700B and 1720B respectively. An arc developing between stationary contact 110 and movable contact 140 will also generate an electromagnetic field 1710B. The conductor 195 and contact arm 140 are oriented and disposed such that the effect of electromagnetic fields 1700B and 1720B on the arc does not substantially hinder the directing of the arc into an arc path as compared with other possible implementations.

Figure 18B:
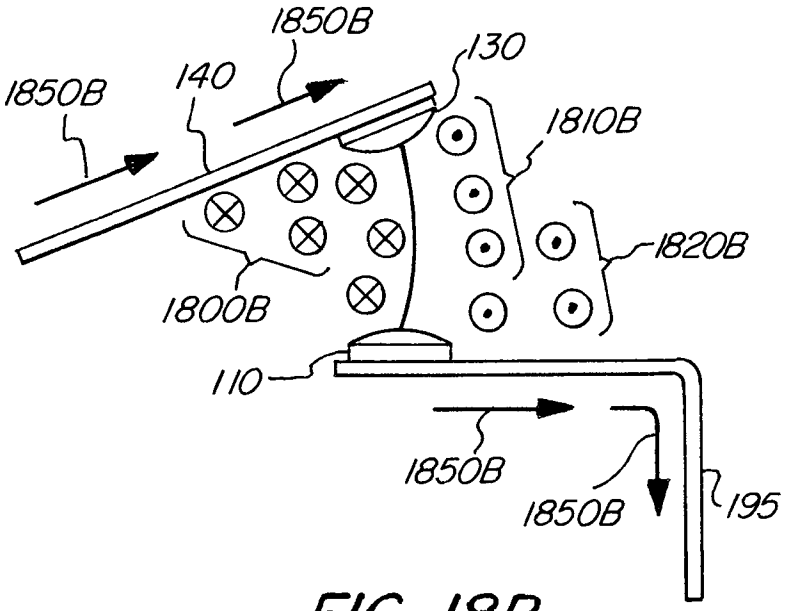
FIGS. 18A and 18B show another example arrangement of certain components of the example circuit interrupters described regarding FIGS. 1-16.
Figure 18A:
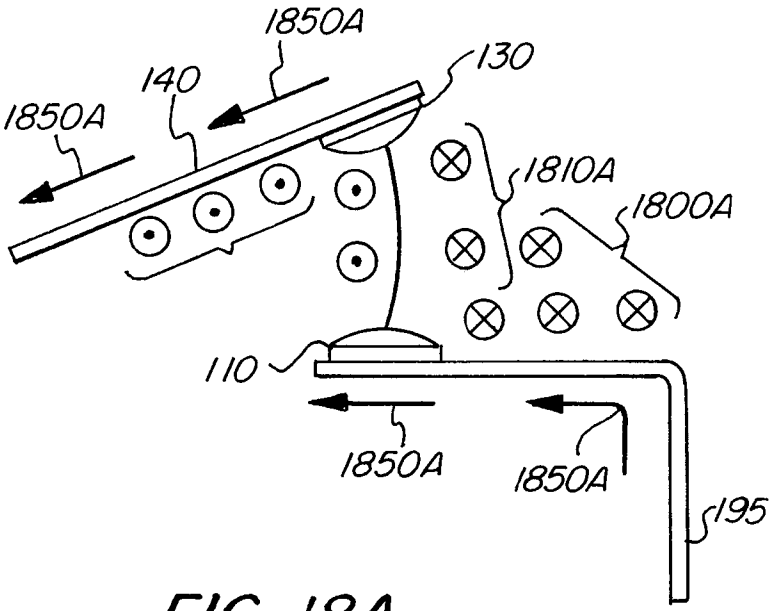

FIGS. 18A and 18B show another arrangement to manage the electromagnetic field generated by current flowing through contact arm 140, and conductor 195 according to aspects of the invention. The arrangement shown in FIGS. 18A and 18B are similar to the arrangement shown in FIGS. 17A and 17B, except in that the conductor 195 is arranged to accommodate a permanent magnet (not shown) positioned beneath stationary contact 110.

When current flows through conductor 195 and contact arm 140 in the direction indicated by arrows 1850A (i.e. line to load), it gives rise to electromagnetic fields 1800A and 1820A respectively. An arc developing between stationary contact 110 and movable contact 140 will also generate an electromagnetic field 1810A. The conductor 195 and contact arm 140 are oriented such that the effect of electromagnetic fields 1800A and 1820A on the arc does not substantially hinder the directing of the arc into an arc path as compared with other possible implementations.

FIG. 18B shows an arrangement to manage the electromagnetic field generated by current flowing through contact arm 140, and conductor 195 according to aspects of the invention.

When current flows through conductor 195 and contact arm 140 in the direction indicated by arrows 1850B (i.e. load to line), it gives rise to electromagnetic fields 1800B and 1820B respectively. An arc developing between stationary contact 110 and movable contact 140 will also generate an electromagnetic field 1810B. The conductor 195 and contact arm 140 are oriented such that the effect of electromagnetic fields 1800B and 1820B on the arc does not substantially hinder the directing of the arc into an arc path as compared with other possible implementations.

Figure 19:
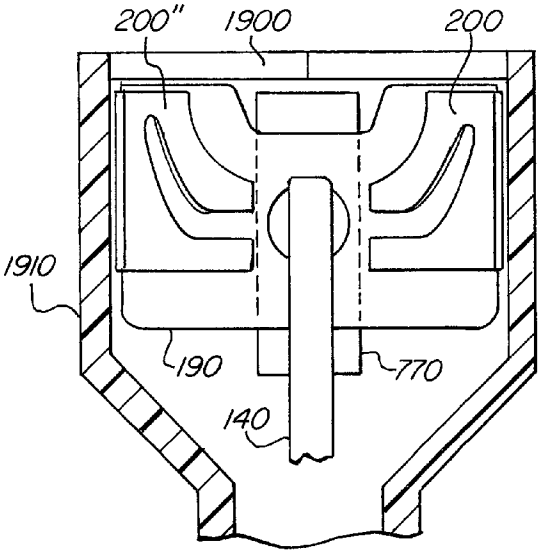
FIG. 19 shows an overhead view of certain components of example circuit interrupters described regarding FIGS. 1-18, illustrating an alternative venting arrangement according to aspects of the invention.

FIG. 19 shows an overhead view of certain components of circuit interrupter 100, illustrating an alternative venting arrangement according to aspects of the invention.

The components shown in FIG. 19 are arranged substantially as shown in FIG. 8, with the addition of housing 1910. Housing 1910 is substantially similar to housing 210 as illustrated in FIG. 2, except that vents 1900 are shown in an elongated configuration, which differs from the configuration of vents 220, 220' shown in FIG. 2.

Figure 20:
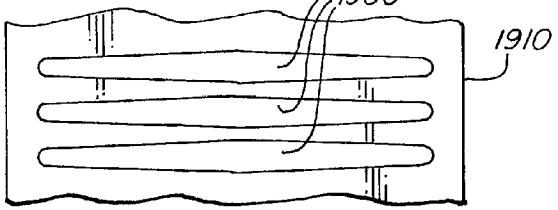
FIG. 20 shows an overhead view of certain components of example circuit interrupters described regarding FIGS. 1-18, illustrating another alternative venting arrangement according to aspects of the invention.

FIG. 20 illustrates a side view of housing 1910 and vents 1900. Vents 1900 provide the advantage of allowing for increased flow of gasses generated by potential arcing within housing 1910.

Figure 21:
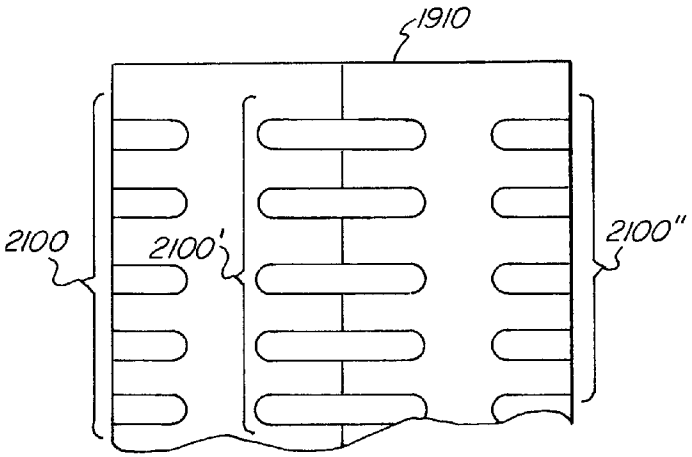
FIG. 21 shows an overhead view of certain components of example circuit interrupters described regarding FIGS. 1-18, illustrating a further alternative venting arrangement according to aspects of the invention.

FIG. 21 illustrates another side view of housing 1910 showing another alternative venting arrangement. Vents 2100, 2100', 2100" are aligned in a manner substantially similar to vents 1900 as shown in FIGS. 19 and 20, except that vents do not extend in the portions of housing 1910 between vents 2100 and 2100', and the portions between vents 2100' and 2100". This provides the advantage of encouraging a desirable flow of gasses generated by arcing within housing 1910, while also providing shielding over regions of the interior of housing 1910 where the arc will be directed according to aspects of the invention.

Figure 22:
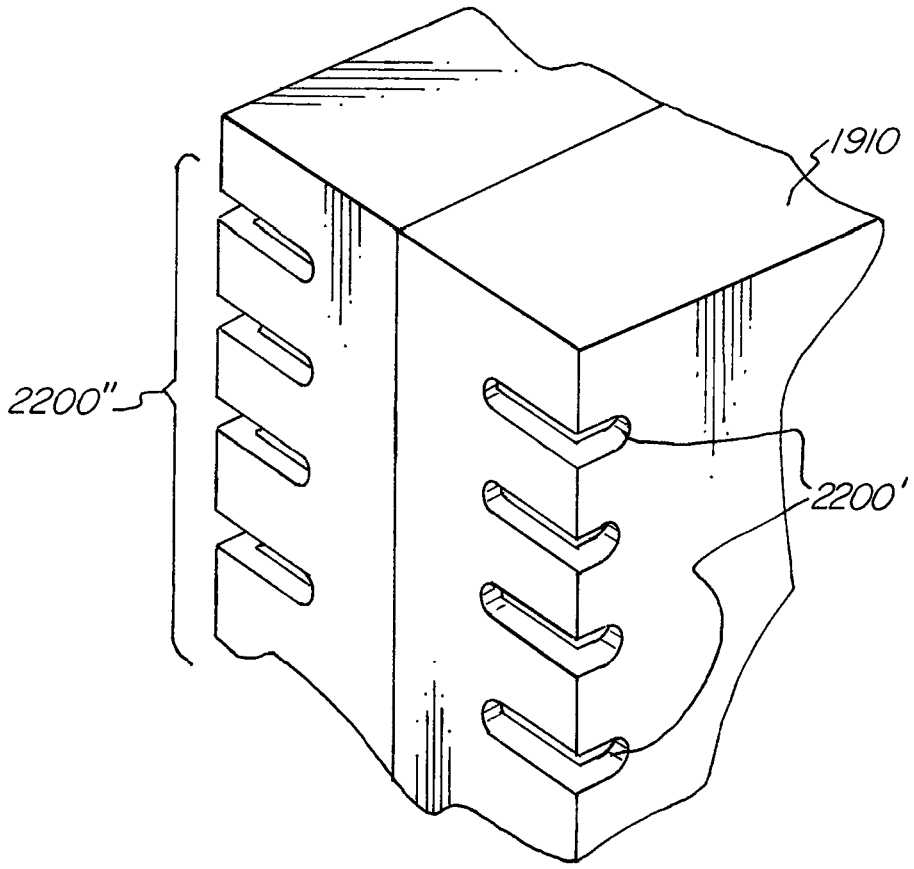
FIG. 22 is an orthographic view of certain components of example circuit interrupters described regarding FIGS. 1-18, illustrating still another alternative venting arrangement according to aspects of the invention.

FIG. 22 is an perspective view of the housing 1910 including vents 2200, 2200', 2200", showing a further alternative arrangement.

Although the invention has been described with reference to a particular arrangement of parts, features and the like, these are not intended to exhaust all possible arrangements or features, and indeed many modifications and variations will be ascertainable to those of skill in the art.

What is claimed is:

1. A circuit interrupter providing for arc suppression, said circuit interrupter comprising:

a first contact electrically connectable to a power source;

a second contact electrically connectable to a load;

said first and second contacts being actuated between a closed and open position relative to each other;

an arc extinguisher for extinguishing an arc that develops in the vicinity of said first and second contacts; and a permanent magnet disposed adjacent to at least one of the contacts and generating a magnetic field that permeates an area where the arc develops;

said magnetic field directing the arc toward said arc extinguisher regardless of a polarity of the contacts.

2. The circuit interrupter of claim 1, wherein said arc extinguisher comprises a first arc path and a second arc path.

3. The circuit interrupter of claim 2, wherein the first arc path extends in a direction substantially parallel to the second arc path.

4. The circuit interrupter of claim 2, wherein first arc path extends in a direction substantially perpendicular to the second arc path.

5. The circuit interrupter of claim 2, wherein said permanent magnet is disposed to direct the arc toward the first arc path when a polarity of the first contact is positive, and is disposed to drive the arc into the second arc path when the polarity of the first contact is negative.

6. The circuit interrupter of claim 2, wherein the first arc path and the second arc path comprise a plate for splitting the arc.

7. The circuit interrupter of claim 2, wherein the first arc path comprises a first plate and the second arc path comprises a second plate.

8. The circuit interrupter of claim 2, wherein the first arc path and the second arc path comprise a common arc runner.

9. The circuit interrupter of claim 2, further comprising a lower arc runner electrically coupled to the first contact and having a first tab extending beneath the first arc path and a second tab extending beneath the second arc path.

10. The circuit breaker of claim 1, wherein said permanent magnet comprises a first permanent magnet, the circuit breaker further comprising a second permanent magnet positioned such that the magnetic field produced by the first permanent magnet extends to the second permanent magnet through an area between the first contact and the second contact.

11. The circuit breaker of claim 10, wherein the first permanent magnet is offset along a longitudinal axis relative to the second permanent magnet.

12. The circuit interrupter of claim 1, wherein the permanent magnet is positioned such that the first contact is between the permanent magnet and the second contact.

13. The circuit interrupter of claim 1, wherein the permanent magnet is a torridly shaped magnet.

14. The circuit interrupter of claim 13, wherein an axis of revolution of the torridly shaped magnet intersects the first contact.

15. The circuit interrupter of claim 13, wherein the torridly shaped magnet surrounds a conductor that is electrically coupled to the first contact.

16. The circuit interrupter of claim 1, further comprising at least one pole piece disposed to direct the magnetic field.

17. The circuit interrupter of claim 16, wherein the at least one pole piece is disposed to concentrate the magnetic field in the area where the arc develops.

18. The circuit interrupter of claim 1, wherein said arc extinguisher comprises at least one plate for splitting the arc.

19. A circuit interrupter comprising:

a first contact electrically connectable to a power source;

a second contact electrically connectable to a load;

said first and second contacts being actuated between a closed and open position relative to each other;

an arc extinguisher for extinguishing an arc that develops in the vicinity of said first and second contacts, said arc extinguisher having a first arc path and a second arc path;

a first permanent magnet generating a first magnetic field and positioned on a side of said first contact opposite from said second contact; and a second permanent magnet generating a second magnetic field and positioned on a side of said second contact opposite from said first contact;

wherein the first and second magnetic fields interact with the arc so as to direct the arc to said arc extinguisher regardless of an instantaneous polarity of said contacts.

20. The circuit interrupter of claim 19, wherein the first arc path and the second arc path comprise a plate for splitting the arc.

* * * * *